US005078805A

United States Patent [19]

Uesugi et al.

[11] Patent Number: 5,078,805

[45] Date of Patent: Jan. 7, 1992

[54] METHOD OF PRODUCING SUPPORT FOR PLANOGRAPHIC PRINTING-PLATE

[75] Inventors: Akio Uesugi; Tsutomu Kakei, both of Shizuoka, Japan

[73] Assignee: Fuji Photo Film Co., Ltd., Kanagawa, Japan

[21] Appl. No.: 570,561

[22] Filed: Aug. 21, 1990

[30] Foreign Application Priority Data

Aug. 22, 1989 [JP] Japan ..... 1-214123

[51] Int. Cl.[5] ..... B22D 21/00

[52] U.S. Cl. ..... 148/2; 148/3; 148/437; 164/476; 164/477

[58] Field of Search ..... 148/2, 3, 437; 164/476, 164/477

[56] References Cited

U.S. PATENT DOCUMENTS 4,800,950 1/1989 Crona et al. ..... 164/476
4,818,300 4/1989 Rooy et al. ..... 148/2

FOREIGN PATENT DOCUMENTS 55-19191 5/1980 Japan .
56-19280 5/1981 Japan .

*Primary Examiner*—R. Dean
*Assistant Examiner*—Robert R. Koehler
*Attorney, Agent, or Firm*—Sughrue, Mion, Zinn Macpeak & Seas

[57] ABSTRACT

A support for a planographic printing plate is produced by continuously performing casting and hot-rolling from molten aluminum to form a hot-rolled coil of a thin plate, transforming the hot-rolled coil into an aluminum support through cold-rolling, heat-treatment and correction, and finally, graining the aluminum support.

3 Claims, 1 Drawing Sheet

METHOD OF PRODUCING SUPPORT FOR PLANOGRAPHIC PRINTING-PLATE

BACKGROUND OF THE INVENTION

The present invention generally relates to a method of producing a support for a planographic printing plate, and particularly relates to a method of producing an aluminum support which is superior in an electrolytically graining property.

Conventionally, an aluminum plate (including aluminum alloy) has been used as a printing plate, such as an offset printing plate. Usually, in offset printing, it is necessary to apply a suitable adhesion and a suitable amount of water between the surface of the aluminum plate and a photosensitive layer.

The surface of the aluminum plate should be uniformly and finely grained to meet the aforesaid requirements. This graining process largely affects a printing performance and a durability of the printing plate upon the printing process following manufacture of the plate. Thus, it is important for the manufacture of the plate whether such graining is satisfactory or not.

In general, an alternating current electrolytic graining method is used as the method of graining an aluminum support for a printing plate. There are a variety of suitable alternating currents, for example a sinewaveform, a squarewaveform, a special alternating waveform and the like. When the aluminum support is grained by alternating current supplied between the aluminum plate and an opposite electrode such as a graphite electrode, this graining is usually conducted only one time, as the result of which, the depth of pits formed by the graining is small over the whole surface thereof. Also, the durability of the grained printing plate during printing will deteriorate. Therefore, in order to obtain a uniformly and closely grained aluminum plate satisfying the requirement of a printing plate with deep pits as compared with their diameters, a variety of methods have been proposed as follows.

One method is a graining method to use a current of particular waveform for an electrolytic source (Japanese Patent Laid-Open No. Sho 53-67507). Another method is to control a ratio between an electricity quantity of a positive period and that of a negative period at the time of alternating electrolytic graining (Japanese Patent Laid-Open No. Sho 54-65607). Still another method is to control the waveform supplied from electrolytic source (Japanese Patent Laid-Open No. Sho 55-25381). Finally, another method is directed to a combination of current density (Japanese Patent Laid-Open No. Sho 56-29699).

Further, known is a graining method using a combination of an AC electrolytic etching method with a mechanical graining method (Japanese Patent laid-Open No. Sho-55-142695).

As the method of producing an aluminum support, on the other hand, known in a method in which an aluminum ingot is melted and held, and then cast into a slab (having a thickness in a range from 400 to 600 mm, a width in a range from 1000 to 2000 mm, and a length in a range from 2000 to 6000 mm). Then, the thus cast slab is subject to a surface-cutting step in which the slab surface is cut off by 3–10 mm with a surface cutting machine so as to remove an impurity structure portion on the surface. Next, the slab is subject to a soaking treatment step in which the slab is kept in a holding furnace at a temperature in a range from 480° to 540° C. for a time in a range from 6 to 12 hours, thereby to remove any stress inside the slab and make the structure of the slab uniform. Then, the thus treated slab is hot-rolled at a temperature in a range from 480° to 540° C. to a thickness in a range from 5 to 40 mm. Thereafter, the slab is cold-rolled at the room temperature to a predetermined thickness. Then, in order to make the structure uniform and improve the flatness of the plate, the thus treated slab is annealed thereby to make the rolled structure, etc. uniform, and the slab is then subject to correction by cold-rolling to a predetermined thickness. Such an aluminum plate obtained in the manner as described above has been used as a support for a planographic printing plate.

Currently, the quantity of production of planographic printing plates increases with growth of demand therefor, and a large quantity of planographic printing plates having a constant quality are required to be produced. The electrolytic graining treatment is, however, apt to be affected particularly by an aluminum support to be grained. In the case of producing an aluminum support through the foregoing process, including the steps of melting and holding, casting, surface cutting and soaking, a scattering of a metal alloy component or the like is generated in surface layer of the aluminum support even if heating and cooling are repeated and surface-cutting for cutting the surface layer is performed, resulting in reduction of the yield of the aluminum support to be used as a planographic printing plate support.

SUMMARY OF THE INVENTION

Therefore an object of the present invention is to provide a method of producing a support for a planographic printing plate in which scattering (i.e., variation) of the quality of an aluminum support is reduced, thereby to improve the yield in the electrolytic graining treatment so that a planographic printing plate having a superior quality and an improved yield can be produced.

In order to attain the above objects, according to the present invention, the method of producing a support for a planographic printing plate, comprises the steps of: continuously performing casting and hot-rolling from molten aluminum to form a hot-rolled coil of a thin plate; obtaining an aluminum support from the hot-rolled coil through cold-rolling, heat-treatment, and correction; and performing graining on the aluminum support.

As the method of continuously performing casting and hot-rolling from the molten aluminum to form a hot-rolled coil of a thin plate, a thin-plate continuous casting technique such as a Hazley method, a Hunter method, a 3C method, etc., has been put into practical use. Further, Japanese Patent laid-Open Nos. Sho-60-238001, Sho-60-240360, etc., disclose a method of forming a hot-rolled coil of a thin plate.

Although each of those methods has an advantage and a disadvantage, the feature of the present invention is in using a hot-rolled coil of a thin plate directly formed from molten aluminum.

According to the present invention, a thin hot-rolled coil is formed from molten aluminum through continuous casting and hot-rolling, so that generation or mixing-in of an oxide is reduced in comparison with the conventional process and it is not necessary to perform a surface cutting step. Therefore, the cost of equipment decreases and the running cost also decreases.

Further, the support obtained according to the present invention has an excellent quality as a support for a planographic printing plate particularly using a photosensitive material.

DETAILED DESCRIPTION OF THE PREFERRED EMBODIMENTS OF THE INVENTION

Figure 1:
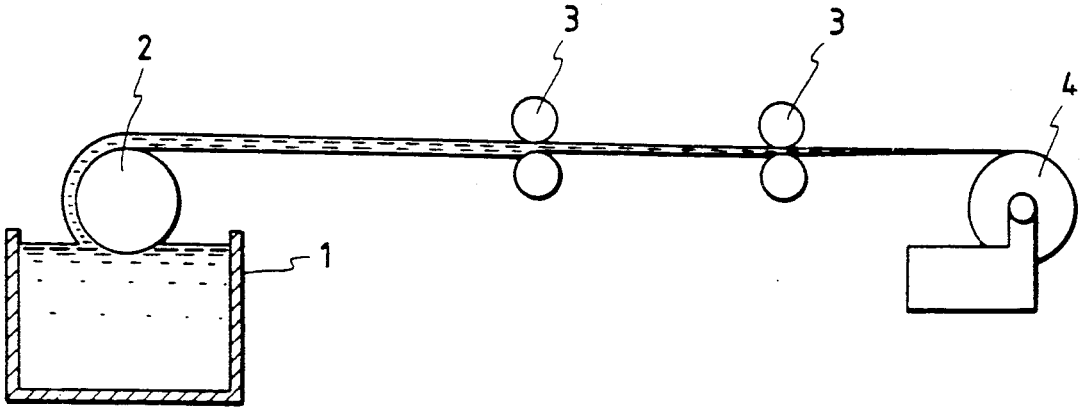
FIG. 1 is a schematic view for explaining a part of the process of the method of producing an aluminum support according to the present invention.

An embodiment of the method of producing an aluminum support to be used according to the present invention will be described more specifically with reference to the schematic view of FIG. 1, which explains the producing process. An ingot is melted and held in a melting and holding furnace 1 so that the molten metal is sent to a casting machine 2 and hot-rolling machines 3. That is, a hot-rolled coil of a thin plate is directly formed from molten aluminum and taken up by a coiler 4.

The producing conditions in those parts will be described more in detail. It is necessary to maintain the temperature in the melting and holding furnace 1, i.e., the molten aluminum, to a value not lower than the melting point of aluminum. The melting point varies depending on the components of the aluminum alloy and generally takes a value of 800° C. or more.

Further, inclusions such as an oxide, etc., and alkali metals such as sodium, etc., are contained in the molten aluminum, and it is therefore necessary to remove such harmful materials. As the method of removing such harmful materials, flux treatment, chlorine treatment, etc., are generally used. As the flux, ethane hexachloride is most widely used.

Next, the molten aluminum is cast by the casting machine 2. There are various casting systems which are roughly grouped into a movable-mold system and a fixed-mold system. Almost all the current industrially-running casting methods are the Hunter method, the 3C method, the Hazley method, etc., which belong to the movable-mold system. Although the casting temperature is different between the movable-mold and fixed-mold methods from each other, the most suitable casting temperature is about 700° C. A 100–300 mm thick slab obtained in such a continuous casting method as described above is hot-rolled.

The hot-rolling machine 3 is constituted by breaking-down rolls and finishing rolls. The slab is hot-rolled so as to be formed into a strip having a thickness in a range from 10 to 50 mm, and is taken up by the coiler 4 so as to be formed into a coil. With respect to the conditions in the hot-rolling machine 3, the suitable temperature is in a range from 350° to 550° C. because the temperature gives an influence particularly on the electrolytic grain property of a support for a planographic printing plate.

Next, the thus obtained aluminum coil is cold-rolled so as to have a predetermined thickness. Steps of intermediate annealing, cold-rolling and the like may be further inserted in the producing process in accordance with the desired quality of the aluminum. Next, an aluminum support is formed from the aluminum coil through the steps of heat-treatment and correction, and then the obtained aluminum support is grained. The correction is sometimes included in the final cold-rolling step.

As the method of performing the graining on the support for a planographic printing plate according to the present invention, employed is a mechanical graining method, a chemical graining method, an electrochemical graining method, or any combination of the foregoing graining methods.

As the mechanical graining method, known are, for example, ball graining, wire graining, brush graining, solution honing, etc. As the electrochemical graining method, an AC electrolytic etching method is generally used. As the current, a usual AC sinusoidal current or a special alternating current such as a square wave or the like is used. Further, etching treatment using a caustic soda or the like may be performed as the pretreatment for the electrochemical graining.

In performing electrochemical graining, it is preferable to perform graining by use of an AC current in an aqueous solution mainly containing a hydrochloric acid or a nitric acid. This electrochemical graining method will be described in detail hereunder.

First of all, an aluminum support is etched by an alkaline. A preferable alkaline agent includes caustic soda, caustic potash, metasilicate soda, sodium carbonate, aluminate soda, gluconate soda or the like. It is preferable that a concentration of the alkaline agent is in the range from 0.01 to 20%, a temperature of the etching liquid is in the range from 20° to 90° C. and an etching period is in the range from 5 secs. to 5 mins. Also, a preferable etching amount is in the range from 0.01 to 5 g/m$^2$, and regarding an aluminum support containing a relatively large amount of impurities, a preferable etching amount is in the range from 0.01 to 1 g/m$^2$.

Additionally, if an insoluble smut remains on the surface of the aluminum plate, a desmut treatment may be performed, if necessary.

After pre-treatment as described above has been performed, AC electrolytic etching is performed to the aluminum plate in an electrolytic liquid mainly containing a hydrochloric acid or a nitric acid. Preferably, the frequency of the AC electrolytic current is selected to be in a range from 0.1 to 100 Hz, more preferably in a range from 0.1 to 1.0 Hz or from 10 to 60 Hz.

Preferably, the solution concentration is in a range from 3 to 150 g/l, more preferably in a range from 5 to 50 g/l. Preferably, the quantity of aluminum dissolution in the bath is not larger than 50 g/l, more preferably in a range from 2 to 20 g/l. An additive may be added if necessary. In the case of addition of an additive, however, it becomes difficult to control the solution concentration in mass production.

Preferably, the current density is selected to be in a range from 5 to 100 A/dm$^2$, more preferably in a range from 10 to 80 A/dm$^2$. Further, although the waveform of the power source may be properly selected in accordance with a desired quality and components of an aluminum support to be used, and so on. It is preferable to use such a special alternating waveform as disclosed in U.S. Pat. No. 4,087,344. The waveform and solution conditions are properly selected in accordance with the quantity of electricity, the desired quality, the compositions of an aluminum support to be used, and so on.

Next, the electrolytically grained aluminum is immersed in an alkali solution as a part of the desmutting treatment, thereby to dissolve smuts. As the alkali agent, there are various agents such as a caustic soda and the like. It is preferable to perform the immersion in PH 10 or more, at a temperature in a range from 25° to 60° C., and in an extremely short time in a range from 1 to 10 sec.

Next, the aluminum support is immersed in a solution mainly containing a sulfuric acid. As the solution conditions of the sulfuric acid, preferably, the concentration is selected to a value in a range from 50 to 400 g/l so as to be lower than the conventional value and the temperature is selected to a value in a range from 25° to 60° C., both of which are lower than the values in the conventional case. If the concentration of the sulfuric acid is not lower than 400 g/l or the temperature of the same is not lower than 65° C., corrosion of a treatment cell or the like increases, and grain formed by electrochemical graining breaks in the case of using an aluminum alloy containing manganese by 0.3% or more. Further, if the quantity of dissolution of etched aluminum base is not smaller than 0.2 g/m$^2$, the durability against printing reduces. Accordingly, it is preferable to select the quantity of dissolution to be not larger than 0.2 g/m$^2$. It is preferable that an oxidized surface of the anode have an amount within a range from 0.1 to 10 g/m$^2$, more preferably within a range from 0.3 to 5 g/m$^2$.

Although the anodic oxidation treatment conditions vary in accordance with an electrolyte to be used and cannot be determined fixedly, it is generally suitable to select the concentration of the electrolyte to be within a range from 1 to 80 wt. %, the solution temperature to be within a range from 5° to 70° C., the current density to be within a range from 0.5 to 60 A/cm$^2$, the voltage to be within a range from 1 to 100 V, and the electrolytic time to be within a range from 1 sec to 5 mins.

A photosensitive coating can be formed immediately on the grained aluminum plate because the thus obtained grained aluminum plate having the anode surface oxide coating is stable itself and superior in hydrophilic property. If necessary, however, surface treatment may be further performed. For example, a silicate layer of the foregoing alkali metal silicate or an under-coat layer of a hydrophilic polymer compound may be formed. In this case, it is preferable to select the quantity of coating of the under coat layer to be within a range from 5 to 105 mg/m$^2$.

Next, the thus treated aluminum support is coated with a photosensitive coating, and is provided on the thus treated aluminum support, and the aluminum support is made up by picture exposure and development. Then, the made-up aluminum support is set on a printing machine, and printing is started.

EXAMPLES

EXAMPLE 1

An aluminum coil of a 6 mm thick plate was formed by such a continuous thin plate casting apparatus as shown in FIG. 1. Then, the thus obtained aluminum coil was cold-rolled, annealed at 400° C., and cold-rolled (including correction) so as to have a plate thickness of 0.3 mm thereby to form a JIS 1050 material. One hundred coils each of 3 tons weight were produced through the above process (300 tons in total).

The thus formed aluminum plates were used as planographic printing plate supports. Next, each of the aluminum plates was etched in a 15% caustic soda aqueous solution at a temperature of 50° C. so that the quantity of etching was 5 g/m$^2$, and then washed with water. The thus treated aluminum plate was immersed for 10 sec in a 150 g/l sulfuric acid solution of 50° C. so as to be desmutted, and then washed with water.

Further, the support was electrochemically grained in a 16 g/l nitric acid aqueous solution by using such an alternating waveform current as disclosed in the above Japanese Patent Examined Publication No. Sho-55-19191. As the electrolytic conditions, the anode and cathode voltages were selected to be $V_A=14$ V and $V_c=12$ V respectively so that the quantity of electricity in the anode time became 350 coulomb/dm$^2$.

When observation was performed on the 100 supports of coils with electron micrograph after smuts on the surfaces had been removed, it was found that substantially the same and uniform grain was formed on the surface of each of the supports of coils. The mean surface roughness was measured with respect to all the supports of coils. The measured mean value was $x=0.46$ μm and the scattering represented by a standard deviation was $S=0.02$ μm.

An anode surface oxide coating of 2.5 g/m$^2$ was formed on each of the supports in a 20% sulfuric acid, and then dried. Sampling was made on the intermediate portions of the respective coils so as to prepare substrates $A_1 \sim A_{100}$.

COMPARATIVE EXAMPLE 1

A 6 mm thick aluminum plate was formed from an aluminum ingot through a process including melting and holding, slab casting, surface cutting and soaking. Then the aluminum plate was hot-rolled, cold-rolled, annealed at 400° C., and cold-rolled (including correction) so as to have a thickness of 0.3 mm thereby to form a JIS 1050 material.

One hundred coils each 3 tons weight were produced by the above process (300 tons in total).

The thus formed aluminum plates were used as supports for planographic printing plates. Next, each of the aluminum plates was etched in a 15% caustic soda aqueous solution at 50° C. under the same conditions as those of Example 1 so that the quantity of etching was 5 g/m$^2$, and then washed with water. The thus treated aluminum supports were immersed for 10 sec in a 150 g/l sulfuric acid solution at 50° C. so as to be desmutted, and then washed with water.

Further, the supports were electrochemically grained in a 16 g/l nitric acid aqueous solution by using such an alternating waveform current as disclosed in the above Japanese Patent Examined Publication No. Sho-55-19191 under the same conditions as those of Example 1. As the electrolytic conditions, the anode and cathode voltages were selected to be $V_A=14$ V and $V_c=12$ V respectively so that the quantity of electricity in the anode time became 350 coulomb/dm$^2$.

When observation was performed on the 100 supports of coils with electron micrograph after smuts on the surfaces had been removed, it was found that uniform pits were formed on some of the 100 supports while not-uniform pits were formed on the other supports. The measure mean value was $x=0.45$ μm and the scattering represented by a standard deviation was $S=05$ μm. An anode surface oxide coating of 2.5 g/m$^2$ was formed on each of the supports in a 20% sulfuric acid, and then dried. Sampling was made on the intermediate portions of the respective coils so as to prepare substrates $B_1 \sim B_{100}$.

Then, a photosensitive layer was formed on each of the thus prepared substrates $A_1$ through $A_{100}$ and $B_1$ through $B_{100}$ by coating each substrate with the following component so that the weight of coating after being dried became 2.0 g/m$^2$.

| Photosensitive solution | |
|---|---|
| N-(4-hydroxyphenyl), methacrylamide/2-hydroxy ethylmethacrylate/acrylonitrile/ methylmethacrylate/methacrylic acid (= 15:10:30:38:7 mole fraction) copolymer (mean molecular weight 6000) | 5.0 g |
| hexafluorophosphate of condensation product between 4-diazophenyl amine and formaldehyde | 0.5 g |
| phosphorous acid | 0.05 g |
| Aizen victoria pure blue-BOH (produced by HODOGAYA CHEMICAL Co., Ltd.) | 0.1 g |
| 2-methoxy ethanol | 100 g |

The thus produced photosensitive planographic printing plate was subject to exposure through a transparent negative film for 50 sec in a vacuum printing frame with light emitted from a 3 kw metal halide lamp distanced by 1 m. Then, the thus exposed photosensitive planographic printing plate was developed with a developer having the following composition, and gummed with a solution of gum arabic to prepare a final planographic printing plate.

| Developer | |
|---|---|
| sodium sulfite | 5 g |
| benzyl alcohol | 30 g |
| sodium carbonate | 5 g |
| isopropyl naphthalene sodium sulfonate | 12 g |
| pure water | 1000 g |

By use of the thus prepared planographic printing plates, printing was performed in accordance with the usual procedure. As a result, it was found that all the samples of 100 coils in Example 1 came up to the standard, while the samples of 12 coils among the 100 coils in Comparative Example did not come up to the standard.

As described above, the planographic printing plates produced by the method of producing a support for a planographic printing plate according to the present invention are superior in quality and in uniformity, and remarkably good in yield of the made-up printing plates in comparison with the conventional ones. Further, the effect due to reduction in the raw material cost owing to rationalization of the production process of aluminum supports is remarkable, and particularly contributes to the improvement in quality and reduction in cost of the supports for the planographic printing plates.

What is claimed is:

1. A method of producing a support for a planographic printing plate, comprising the steps of:

continuously performing casting and hot-rolling from molten aluminum for forming a hot-rolled coil of a thin plate, wherein said continuously performing step comprises the steps of:

maintaining a body of molten aluminum;

casting a sheet of aluminum from said body using a casting machine;

hot-rolling said sheet of aluminum into thin plate using a hot-rolling machine; and coiling said thin plate into a hot-rolled coil using a coiler machine; obtaining an aluminum support from said hot-rolled coil through cold-rolling, heat-treatment, and correction; and performing graining on said aluminum support;

wherein said body of molten aluminum is maintained at a minimum of 800° C., and said casting step is performed within the temperature range of 650° C. to 750° C. and said sheet of aluminum is cast at a thickness of 100–300 mm.

2. A method of producing a support for a planographic printing plate, comprising the steps of:

continuously performing casting and hot-rolling from molten aluminum for forming a hot-rolled coil of a thin plate, wherein said continuously performing step comprises the steps of:

maintaining a body of molten aluminum;

casting a sheet of aluminum from said body using a casting machine;

hot-rolling said sheet of aluminum into thin plate using a hot-rolling machine; and coiling said thin plate into a hot-rolled coil using a coiler machine;

obtaining an aluminum support for said hot-rolled coil through cold-rolling, heat-treatment, and correction; and performing graining on said aluminum support;

wherein said hot-rolling step is performed within the temperature range of 350° C. to 550° C. and said thin plate is hot-rolled to a thickness of 10–50 mm.

3. A method of producing a support for a planographic printing plate, comprising the steps of:

continuously performing casting and hot-rolling from molten aluminum for forming a hot-rolled coil of a thin plate, wherein said continuously performing step comprises the steps of:

maintaining a body of molten aluminum;

casting a sheet of aluminum from said body using a casting machine;

hot-rolling said sheet of aluminum into thin plate using a hot-rolling machine; and coiling said thin plate into a hot-rolled coil using a coiler machine;

obtaining an aluminum support from said hot-rolled coil through cold-rolling, heat-treatment, and correction;

performing graining on said aluminum support; and, pretreating said body of molten aluminum before performing said casting step, for removing predetermined contaminant materials.

* * * * *